US012765673B2

(12) United States Patent
Li et al.

(10) Patent No.: US 12,765,673 B2
(45) Date of Patent: Oct. 20, 2026

(54) CONTRACTIBLE SOFA LINKAGE DEVICE, SOFA SUPPORT, AND SOFA

(71) Applicant: Remacro Technology Co., Ltd., Suzhou (CN)

(72) Inventors: Xiaohong Li, Suzhou (CN); Xiaoqiang Zhang, Suzhou (CN); Zhanzheng Lv, Suzhou (CN); Yuankun Li, Suzhou (CN)

(73) Assignee: Remacro Technology Co., Ltd., Suzhou (CN)

( * ) Notice: Subject to any disclaimer, the term of this patent is extended or adjusted under 35 U.S.C. 154(b) by 270 days.

(21) Appl. No.: 18/434,819

(22) Filed: Feb. 7, 2024

(65) Prior Publication Data

US 2024/0172876 A1 May 30, 2024

Related U.S. Application Data

(63) Continuation of application No. PCT/CN2022/080373, filed on Mar. 11, 2022.

(30) Foreign Application Priority Data

Aug. 18, 2021 (CN) ..... 202110948461.1
Aug. 18, 2021 (CN) ..... 202110948484.2
Aug. 18, 2021 (CN) ..... 202121945027.X

(51) Int. Cl.
*A47C 1/0355* (2013.01)
*A47C 17/16* (2006.01)
*A47C 17/175* (2006.01)

(52) U.S. Cl.
CPC ..... *A47C 1/0355* (2013.01); *A47C 17/163* (2013.01); *A47C 17/1756* (2013.01)

(58) Field of Classification Search
CPC ..... A47C 1/0355
See application file for complete search history.

(56) References Cited

U.S. PATENT DOCUMENTS 2,869,617 A * 1/1959 Schliephacke ..... A47C 1/0355 297/87
3,004,791 A * 10/1961 Schliephacke ..... A47C 1/0355 297/85 R (Continued)

FOREIGN PATENT DOCUMENTS

CN 108095406 A 6/2018
CN 111685520 A 9/2020

(Continued)

OTHER PUBLICATIONS

International Search Report of PCT Patent Application No. PCT/CN2022/080373 issued on May 19, 2022.

*Primary Examiner* — David R Dunn
*Assistant Examiner* — Tania Abraham

(57) ABSTRACT

A contractible sofa linkage device includes a linkage assembly, a seat frame mount hinged above the linkage assembly, and a leg assembly hinged to a front end of the seat frame mount; an inner side wall of the seat frame mount is provided with a mounting platform, wherein a height of the mounting platform is lower than an upper edge of the seat frame mount, and an angled plane where the mounting platform is positioned is a seat frame mounting surface; the leg assembly includes a footrest link assembly and a footrest member, in which the footrest link assembly is hinged to the seat frame mount, the footrest member includes a footrest plate mounting surface used to mount a footrest plate, and the footrest plate mounting surface is retracted below the seat frame mount when the footrest link assembly drives the footrest member to be retracted to a limit position.

20 Claims, 4 Drawing Sheets

(56) References Cited

U.S. PATENT DOCUMENTS

| | | | | |
|---|---|---|---|---|
| 3,092,415 | A * | 6/1963 | Schliephacke ..... | A47C 1/0355<br>297/89 |
| 2012/0049606 | A1* | 3/2012 | Lawson ..... | A47C 1/0355<br>74/521 |
| 2014/0132038 | A1* | 5/2014 | Lu ..... | A47C 1/035<br>297/68 |
| 2018/0035803 | A1* | 2/2018 | Carrera ..... | A47C 1/0355 |

FOREIGN PATENT DOCUMENTS

| | | | |
|---|---|---|---|
| CN | 211380456 | U | 9/2020 |
| CN | 212546333 | U | 2/2021 |
| CN | 213155030 | U | 5/2021 |
| CN | 113796687 | A | 12/2021 |
| WO | 2020225596 | A1 | 11/2020 |

* cited by examiner

CONTRACTIBLE SOFA LINKAGE DEVICE, SOFA SUPPORT, AND SOFA

CROSS-REFERENCE TO RELATED APPLICATIONS

The present application is a Continuation Application of PCT Application No. PCT/CN2022/080373 filed on Mar. 11, 2022, which claims priority of Chinese Patent Applications No. 202110948484.2 filed on Aug. 18, 2021, No. 202121945027.X filed on Aug. 18, 2021, and No. 202110948461.1 filed on Aug. 18, 2021 before CNIPA. All the above are hereby incorporated by reference in their entirety as part of the present disclosure.

FIELD

The present disclosure relates to the technical field of sofa supports and, particularly, a contractible sofa linkage device, a sofa support, and a sofa.

BACKGROUND

Functional sofas and chairs are becoming increasingly common in life as people's standard of living improves. Functional seats may include loungers, chairs, sofas, combination seats, cinema seats and seating units with mobile seating parts. Functional seats with a retractable mechanism allow adjustment among seating, extending and lying positions by means of the retractable mechanism.

Existing sofas suffer from the following deficiencies: When a seat type is designed with high support legs and low seat height, the movement of the leg assembly is prone to rubbing against the floor, affecting the user's utilization. It's difficult to clean the narrow space at a bottom of the seat frame. In a retracted seating position, the footrests of the leg assembly are retracted in front of the seat, resulting in thick and heavy upholstery in front of the seat, poor aesthetics. It is therefore necessary to provide a contractible sofa linkage device and a sofa based on the prior art, so that the overall thickness thereof is thinner after contraction, providing more space below the seat frame.

SUMMARY

To solve the problem mentioned above, provided in the present disclosure is a contractible sofa linkage device, including a linkage assembly, a seat frame mount hinged to a top of the linkage assembly, and a leg assembly hinged to a front end of a seat frame mount.

An inner side wall of the seat frame mount is provided with a mounting platform, in which a height of the mounting platform is lower than an upper edge of the seat frame mount, and an upper surface of the mounting platform is positioned in an oblique plane and constitutes a seat frame mounting surface.

The leg assembly includes a footrest link assembly and a footrest member, in which the footrest link assembly is hinged to the seat frame mount, the footrest member includes a footrest plate mounting surface used to mount a footrest plate, and the footrest plate mounting surface is retracted below the seat frame mount when the footrest link assembly drives the footrest member to be retracted to a limit position.

Further, the footrest link assembly includes a footrest driving link, a footrest driven link, a first footrest link, and a second footrest link.

The footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, and an opposite end of the second footrest link is hinged to a middle of the footrest member.

Further, a vertical distance from a connecting point between the first footrest link and the footrest member to the footrest plate mounting surface is greater than a vertical distance from a connecting point between the second footrest link and the footrest member to the footrest plate mounting surface.

Further, an included angle $\alpha$ between the footrest plate mounting surface and a horizontal plane is 20°-26° when the leg assembly is retracted to a limit position.

Further, a distance H2 between a highest point where the seat frame mount is positioned on the seat frame mounting surface and a highest point of the footrest plate mounting surface in a vertical direction is not greater than 50 mm when the leg assembly is retracted to a limit position.

Preferably, the footrest plate mounting surface is perpendicular to a horizontal plane and a distance H3 between a highest point where the seat frame mount is positioned on the seat frame mounting surface and a lowest point of the footrest member in a vertical direction is not greater than 95 mm when the leg assembly is retracted to a limit position.

Further, the linkage assembly includes a linkage restricting member, a mounting lateral plate, a backrest connecting member, and a leg driven member.

An end of the linkage restricting member is hinged to a middle of the seat frame mount, an opposite end of the linkage restricting member is hinged to an end of the mounting lateral plate, an opposite end of the mounting lateral plate is connected to the backrest connecting member, an end of the leg driven member is hinged to the mounting lateral plate, and an opposite end of the leg driven member is connected to the leg assembly.

Further, the linkage restricting member includes a first connecting end connected to the mounting lateral plate and a second connecting end connected to an outer side wall of the seat frame mount, and an opening direction of an included angle formed by connecting the first connecting end and the second connecting end is facing the seat frame mount.

Further, a connecting point between the leg driven member and the mounting lateral plate is positioned in an opening direction of an included angle formed by connecting the first connecting end and the second connecting end.

Preferably, the mounting lateral plate and the backrest connecting member are fixedly connected or integrally formed.

Provided in the present disclosure is further a sofa support, including a linkage assembly, a seat frame mount, a leg assembly, and a backrest member, in which the seat frame mount is hinged to a top of the linkage assembly, the leg assembly is hinged to a front end of the seat frame mount, and the backrest member is hinged to an end of the seat frame mount distal to the leg assembly.

An inner side wall of the seat frame mount is provided with a mounting platform, in which a height of the mounting platform is lower than an upper edge of the seat frame mount, and a plane where the mounting platform is positioned is a seat frame mounting surface; the leg assembly includes a footrest link assembly and a footrest member, in which the footrest link assembly is hinged to the seat frame mount, the footrest member includes a footrest plate mounting surface used to mount a footrest plate, and the footrest plate mounting surface is retracted below the seat frame mount when the footrest link assembly drives the footrest member to be retracted to a limit position.

A distance H1 between a highest point where the seat frame mount is positioned on the seat frame mounting surface and a lowest point of the leg assembly in a vertical direction is not greater than 170 mm when the sofa support is retracted to a limit position.

Further, the linkage assembly includes a linkage restricting member, a mounting lateral plate, a backrest connecting member, and a leg driven member.

An end of the linkage restricting member is hinged to a middle of the seat frame mount, an opposite end of the linkage restricting member is hinged to an end of the mounting lateral plate, an opposite end of the mounting lateral plate is connected to the backrest connecting member, an end of the leg driven member is hinged to the mounting lateral plate, an opposite end of the leg driven member is connected to the leg assembly, and the backrest connecting member is hinged to a middle of the backrest member.

Further, a difference in height H between the footrest plate mounting surface and a highest point of the backrest member is not less than 80 mm when the leg assembly is extended to a limit position.

Further, the mounting platform is a bent part formed by bending inward a lower edge of the seat frame mount.

Provided in the present disclosure is further a sofa, including a seat support leg, an armrest frame, and the sofa support mentioned above.

There are two sets of sofa supports disposed oppositely, the sofa support is connected to the armrest frame, the seat support leg is provided below the armrest frame, and a height of the seat support leg is 120-150 mm.

Further, a footrest plate, and the footrest plate is fixedly connected to the footrest plate mounting surface; when the footrest plate is retracted to a limit position and the footrest plate mounting surface is oblique with respect to a horizontal plane, a length L of a footrest surface of the footrest plate of a leg assembly is not less than 200 mm.

BRIEF DESCRIPTION OF THE DRAWINGS

In order to illustrate the technical solutions of the present disclosure more clearly, the following drawings are briefly introduced as required in the context of the embodiments or the prior art. Obviously, the following drawings illustrate only some of the embodiments of the present disclosure. Other relevant drawings may be obtained on the basis of these drawings without any creative effort by those skilled in the art.

Figure 1:
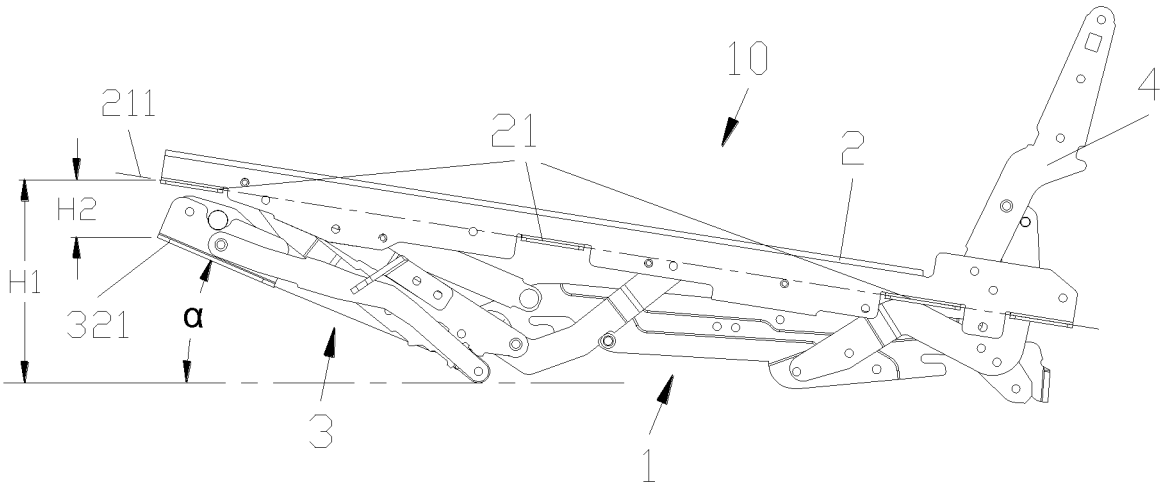
FIG. 1 is a structural diagram of the sofa support in embodiment 1 of the present disclosure.

Labels: 10 sofa support; 1 linkage assembly; 11 linkage restricting member; 111 first connecting end; 112 second connecting end; 12 mounting lateral plate; 13 backrest connecting member; 14 leg driven member; 15 elastic restoration member; 2 seat frame mount; 21 mounting platform; 211 seat frame mounting surface; 3 leg assembly; 31 footrest link assembly; 311 footrest driving link; 312 footrest driven link; 313 first footrest link; 314 second footrest link; 315 extension footrest; 316 footrest connecting member; 317 restricting member; 32 footrest member; 321 footrest plate mounting surface; 4 backrest member; 5 seat support leg; 6 armrest frame; 7 footrest plate.

DETAILED DESCRIPTION OF THE EMBODIMENTS

The technical solutions in the examples of the present disclosure are clearly and completely described and discussed below in conjunction with the attached drawings of the embodiments of the present disclosure. Obviously, the examples described herein are only some of the examples of the present disclosure but not all of them. Based on the embodiments in the present disclosure, all other embodiments obtained by those skilled in the art without creative efforts fall within the scope of protection of the present disclosure.

References herein to "an embodiment" or "embodiments" refer to particular features, structures or characteristics that may be included in at least one embodiment of the present disclosure. In the description of the present disclosure, it is to be understood that the terms "up", "down", "front", "back", and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure. Furthermore, the related terms "first", and "second" are used for descriptive purposes only and are not to be understood as indicating or implying relative importance or implicitly specifying the number of technical features indicated. As a result, a feature defined as "first" or "second" may expressly or implicitly include one or more such features. The terms "first", "second" and the like are used to identify different objects and are not intended to describe a particular sequence or order. It should be understood that the data herein used may be interchangeable in appropriate cases so that the embodiment of the present disclosure described herein may be implemented in an order other than what is illustrated or described herein.

In the present disclosure, unless otherwise explicitly specified and limited, the term "mount", "connect" and the like should be understood in a broad sense, for example, as a fixed connection, as a detachable connection, as an integral connection, as a mechanical connection, as an electrical connection, as a direct connection, as an indirect connection through an intermediate medium, or as a connection within two elements. For those skilled in the art, the specific meaning of the above terms in the context of the present invention may be understood according to the specific situation.

In the present embodiment, the "inner" side is between the two facing sofa supports, and the "outer" side is in an opposite direction thereof. The extension direction of the leg assembly is "forward" and an opposite direction thereof is "backward".

In view of the problems mentioned above of the prior art, an objective of the present disclosure is to provide a contractible sofa linkage device, a sofa support, and a seat unit, which allows the structure of the seat frame mount, linkage assembly and leg assembly to be adjusted so that a vertical height of the sofa support is reduced after retraction, a thickness of the sofa support is thinner, and the space at a bottom of the seat frame is increased.

Embodiment 1

As shown in FIGS. 1-6, Provided in the present embodiment 1 is a contractible sofa linkage device, including a linkage assembly 1, a seat frame mount 2 hinged to a top of the linkage assembly 1, and a leg assembly 3 hinged to a front end of the seat frame mount 2. Specifically, an inner side wall of the seat frame mount 2 is provided with a mounting platform 21, in which a height of the mounting platform 21 is lower than an upper edge of the seat frame mount 2, and an upper surface of the mounting platform is positioned in an oblique plane and constitutes a seat frame mounting surface 211. It should be noted that, there may be a plurality of mounting platforms. In the present embodiment, the mounting platform 21 is a bent part formed by inwardly bending a lower edge of the seat frame mount 2. Four mounting platforms 21 are provided along a length direction of the seat frame mount 2, and the seat frame may be fixed and mounted on the mounting platforms 21 by means of fasteners such as bolts and nuts, or rivets. A length of the mounting platform 21 of the present disclosure is lowered, so that the seat frame is lowered to be mounted, resulting in a lower seat height and a deeper seat depth. With the sofa height unchanged and the seat frame mounting surface 211 lowered, a height of the seat legs is increased and the space under the seat frame is increased, which also allows for an increase in the thickness of the sofa cushion upholstery and an increase in the level of comfort.

Figure 2:
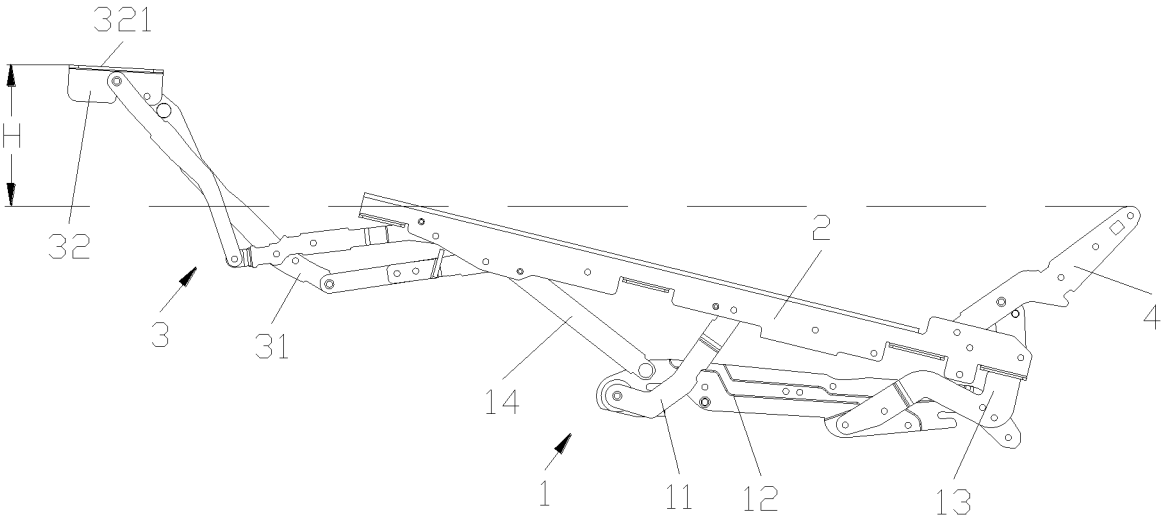
FIG. 2 is a structural diagram of the sofa support in embodiment 1 of the present disclosure in a lying position.
Figure 3:
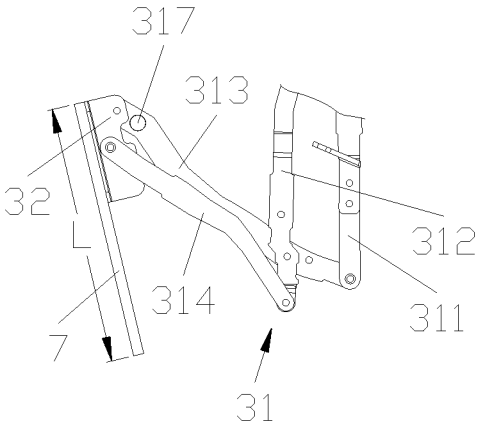
FIG. 3 is a structural diagram of the leg assembly and the footrest plate of the sofa support in embodiment 1 of the present disclosure.

In the present embodiment, the leg assembly 3 includes a footrest link assembly 31 and a footrest member 32, wherein the footrest link assembly 31 is hinged to the seat frame mount 2, the footrest member 32 comprises a footrest plate mounting surface 321 used to mount a footrest plate 7, and the footrest plate mounting surface 321 is retracted below the footrest link assembly 31 when the footrest link assembly 31 drives the footrest member 32 to be retracted to a limit position. Specifically, as shown in FIGS. 2-3, the footrest link assembly 31 includes a footrest driving link 311, a footrest driven link 312, a first footrest link 313, a second footrest link 314, and a footrest member 25, wherein the footrest driving link 311 and the footrest driven link 22 are hinged to a front end of the seat frame mount 2 respectively, an end of the first footrest link 313 is hinged to the footrest driving link 311, an opposite end of the first footrest link 23 is hinged to an end of the footrest member 32, an end of the second footrest link 314 is hinged to the footrest driven link 312, and an opposite end of the second footrest link 24 is hinged to a middle of the footrest member 32.

Specifically, in the present embodiment, a vertical distance from a connecting point between the first footrest link 313 and the footrest member 32 to the footrest plate mounting surface 321 is greater than a vertical distance from a connecting point between the second footrest link 314 and the footrest member 32 to the footrest plate mounting surface 321, so that the footrest member is oblique with respect to a horizontal plane after retracted. Specifically, an included angle $\alpha$ between the footrest plate mounting surface 321 and a horizontal plane is 20°-26° when the leg assembly 3 is retracted to a limit position. Preferably, $\alpha$ may be 20°, 23°, 25°, or 26°. In the leg assembly 3 of the present embodiment, an included angle $\alpha$ between the footrest plate mounting surface 321 and a horizontal plane is 23° when the leg assembly 3 is retracted to a limit position. As shown in FIG. 1, an included angle between the footrest plate mounting surface 321 and a horizontal plane after contraction is close to an included angle between the footrest link assembly 31 and a horizontal plane. Therefore, in the present embodiment, the footrest mounting surface 321 drives the footrest plate 7 to be retracted so that the footrest mounting surface 321 may be obliquely close to the footrest link assembly 31, which facilitates an increase in a length of the footrest plate 7 without interfering with the ground. A vertical distance H2 between a highest point where the seat frame mount 2 is positioned on the seat frame mounting surface 211 and a highest point of the footrest plate mounting surface 321 is not greater than 50 mm when the leg assembly 3 is retracted to a limit position. Preferably, a vertical distance H2 between a highest point where the seat frame mount 2 is positioned on the seat frame mounting surface 211 and a highest point of the footrest plate mounting surface 321 may be 50 mm, 45 mm, or 40 mm. In the present embodiment, the less the vertical distance H2 is, the thinner and lighter the seat looks like when viewed from the front of the sofa after the leg assembly is 3 retracted.

Specifically, in the present embodiment, a restricting member 317 is further provided on an end of the first footrest link 313 proximal to the footrest member 32, and the second footrest link 314 is provided with a first restricting surface 241 cooperated with the restricting member 317; a current position of the leg assembly 3 is a limit position that the leg assembly 3 is extended to, when the first restricting surface 241 is abutted against the restricting member 317. A lower edge of the footrest member 32 is provided with a second restricting surface 252 cooperated with the restricting member 317, and a current position of the leg assembly 3 is a limit position that the leg assembly 3 is retracted to, when the second restricting surface 252 is abutted against the restricting member 317. In the present embodiment, the restricting member 317 is cooperated with and abutted against the first restricting surface or the second restricting surface, which plays a role in restricting positions and preventing the footrest member 32 from loosening. On the one hand, it may restrict positions to prevent the leg assembly 3 from not retracting or unfolding smoothly due to excessive extension or retraction; on the other hand, it may prevent the footrest member 32 and the footrest plate from easily loosening as they do not retract to a predetermined limit position. Specifically, the linkage assembly 1 includes a linkage restricting member 11, a mounting lateral plate 12, a backrest connecting member 13, and a leg driven member 14. An end of the linkage restricting member 11 is hinged to a middle of the seat frame mount 2, an opposite end of the linkage restricting member 11 is hinged to an end of the mounting lateral plate 12, an opposite end of the mounting lateral plate 12 is connected to the backrest connecting member 13, an end of the leg driven member 14 is hinged to the mounting lateral plate 12, and an opposite end of the leg driven member 14 is connected to the leg assembly 3. The mounting lateral plate 12 is fixedly connected to the backrest connecting member 13 by means of fasteners or is integrally formed with the backrest connecting member 13. In the present embodiment, the linkage assembly is connected to the leg assembly 3 by means of the leg driven member 14, the linkage assembly 1 is connected to the armrest frame 6 by means of the mounting lateral plate 12, and the seat frame mount 2 is rotatably connected to the linkage assembly 1. As the leg assembly is extended, the seat frame mount and linkage assembly are subsequently driven to move and the seat frame mount is moved obliquely upward and forward.

Figure 4:
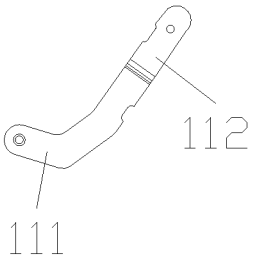
FIG. 4 is a structural diagram of the linkage restricting member in embodiment 1 of the present disclosure.

Specifically, as shown in FIG. 4, the linkage restricting member 11 of the linkage assembly 1 may be a hook-like connecting member. The linkage restricting member 11 comprises a first connecting end 111 connected to the mounting lateral plate 12 and a second connecting end 112 connected to an outer side wall of the seat frame mount 2, and an opening direction of an included angle formed by connecting the first connecting end 111 and the second connecting end 112 is facing the seat frame mount 2. In some embodiments, an included angle formed by connecting the first connecting end 111 and the second connecting end 112 may be an obtuse angle. A connecting point between the leg driven member 14 and the mounting lateral plate 12 is positioned in an opening direction of an included angle formed by connecting the first connecting end 111 and the second connecting end 112, so as to avoid interference between the leg driven member 14 and the linkage restricting member 11 when the leg driven member 14 is rotated. The mounting lateral plate 12 is provided with a restricting structure used to restrict a position of the linkage restricting member 11. The linkage restricting member 11 is abutted against the restricting structure when the leg assembly 3 is extended to a limit position. It should be noted that, in the present embodiment, the leg driven member 14 may be a link structure, in which a connecting point between the leg driven member 14 and the leg assembly 3 is positioned on an outer side of the seat frame mount 2, so as to avoid interference among the leg driven member 14, an inner side of the mounting platform, and the seat frame when the leg driven member 14 is moved.

Figure 5:
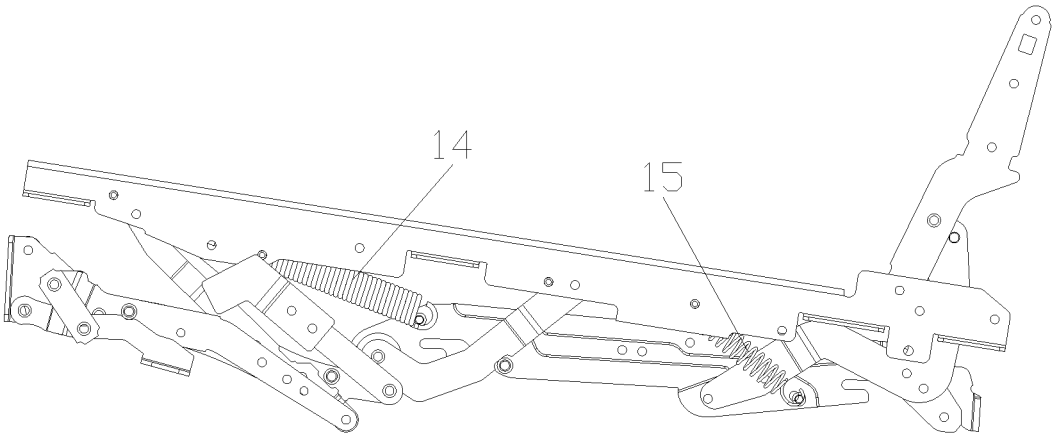
FIG. 5 is a structural diagram of the leg driven member 14 being an elastic connecting member in embodiment 1 of the present disclosure.

Specifically, as shown in FIG. 5, in some other possible embodiments, the leg driven member 14 may be an elastic connecting member. The elastic connecting member may be a spring, in which an end of the spring is connected to the mounting lateral plate 12, and an opposite end of the spring is connected to the leg assembly 3. The elastic connecting member allows a certain amount of elastic restoration force is kept between the leg assembly 3 and the mounting lateral plate 12, which may restrict a movement order of the leg assembly 3 and the backrest member 4, so that a smooth movement of the sofa support may be achieved during extension and retraction. Specifically, when the leg assembly 3 is extended forward from the sitting position, the backrest member 4 is moved forward with the seat frame mount 2 since the elasticity of the leg driven member 14 prevents the backrest member 4 from rotating backward. When the leg assembly 3 is extended to a limit position, the seat frame is oblique and continues to move upward, at which time the backrest member 4 is rotated backward so that the sofa is adjusted from the extending position to the lying position. During retraction, the order of movement is reversed from that described above. When the leg driven member 14 is an elastic connecting member, the sofa may achieve three positions, i.e., a sitting position, an extending position and a lying position. In the sitting position, both the leg assembly 3 and the backrest member 4 are in a retracted state. In the extending position, the leg assembly 3 is extended forward to a limit position, and the backrest member 4 is kept the same as that in the sitting position. In the lying position, the leg assembly 3 is extended forward to a limit position, and the backrest member 4 is rotated backward to a limit position. In the present embodiment, the sofa may further include an elastic restoration member 15, in which the elastic restoration member 15 is provided on a mid-rear part of the seat frame mount 2, an end of the elastic restoration member 15 is connected to an outer side wall of a middle of the seat frame mount 2, and an opposite end of the elastic restoration member 15 is connected to an end of the mounting lateral plate 12 proximal to the backrest connecting member 13. The elastic restoration member 15 allows a certain amount of elastic restoration force between the seat frame mount 2 and the mounting lateral plate 12, so that the seat may achieve a smoother retraction in the lying position. Provided in the present embodiment is further a sofa support, specifically, including a sofa linkage device and a backrest member 4, in which the backrest member 4 is hinged to an end of the seat frame mount 2 distal to the leg assembly 3. The backrest member 4 is hinged to the seat frame mount 2, a middle of the backrest member 4 is rotatably connected to the backrest connecting member 13, and the backrest member 4 is used to connect to and adjust the seat backrest. During the extension and retraction of the linkage assembly, the backrest 4 may be rotated around the seat frame mount 2 to adjust an angle of the seat backrest. A relative position between the seat frame mount 2 and a hinge point between the backrest member 4 and the seat frame mount 2 remains unchanged during the rotation of the backrest member 4. In the present embodiment, the backrest member 4 may be used to be mounted with a conventional rectangular backrest, or may be used to be mounted with a T-shaped backrest structure with two extension parts. A narrower end of the T-shaped backrest is connected to the backrest member, the wider extension parts may be rotated around the seat armrest driven by the backrest member 4.

Specifically, a vertical distance H1 between a highest point where the seat frame mount 2 is positioned on the seat frame mounting surface 20 and a lowest point of the leg assembly 3 is not greater than 170 mm when the sofa support is retracted to a limit position. Preferably, the vertical distance H1 may be 170 mm, 160 mm, 155 mm, or 150 mm. The less the vertical distance H1 is, the thinner the sofa support is compressed after retraction and the less space it takes up in a vertical direction. An overall structure of both the seat frame mount 2 and the leg assembly 3 of the linkage device is compressed, which minimizes the amount of space taken up in a vertical direction, which improves the space utilization, which results in an increase of space in a lower part of the seat frame after the sofa is fully assembled, which facilitates cleaning by cleaning devices, such as mops, sweepers, and so on.

Specifically, a difference in height H between the footrest plate mounting surface 321 and a highest point of the backrest member 4 is not less than 80 mm when the leg assembly 3 is extended to a limit position. Preferably, the difference in height H may be 80 mm, 90 mm, 150 mm, or 200 mm. Compared to a conventional structure, in the present embodiment, the structures of the leg driven member 14 and the linkage restricting member 11 of the linkage assembly allows an increase of an extension height of the seat leg assembly 3. An inclination angle of the seat frame mount 2 is increased driven by the leg assembly 3, increasing the comfort of the seat when the sofa support is unfolded.

Figure 6:
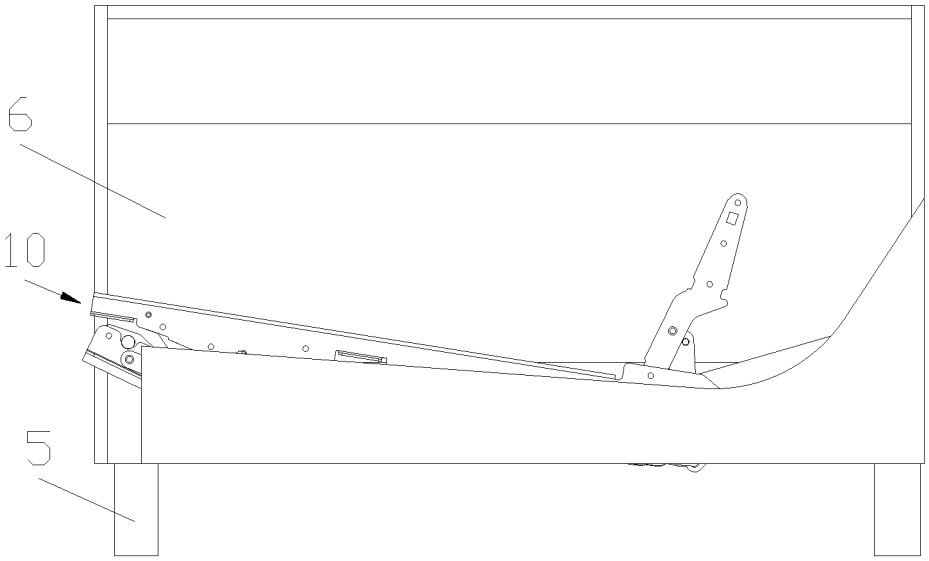
FIG. 6 is a side view of a sofa in embodiment 1 of the present disclosure.

As shown in FIG. 6, provided in the present embodiment is further a sofa, including a seat support leg 5, an armrest frame 6, and a sofa support 10. There are two sets of sofa supports 10 disposed oppositely, the sofa support 10 is connected to the armrest frame 6, the seat support leg 5 is provided below the armrest frame 6, and a height of the seat support leg 5 is 120-150 mm. Preferably, the height of the seat support leg 5 may be 120 mm, 130 mm, or 150 mm. Compared to a conventional sofa support, in the present embodiment, since the sofa linkage device may be compressed thinner in a vertical dimension, a height of the seat support leg may be set higher, and the space in a lower part of the seat frame after the sofa is fully assembled is increased, which may facilitate cleaning by mops, robot cleaners, and other cleaning devices. The conventional sofa support takes up a lot of space due to its complex structure, with seat legs of only about 5 mm, and it is not easy to clean a bottom of the seat as it may not allow cleaning devices such as robot cleaners to pass through.

In the present embodiment, the two sofa supports 10 of the sofa are provided mirrored and spaced apart and are fixed to the armrest frame 6 by means of a mounting lateral plate 12 and fasteners. The seat frame is lowered and mounted on a mounting platform 21, and a height of the mounting platform 21 is lower than an upper edge of the seat frame mount 2.

Specifically, the sofa further includes a footrest plate 7, and the footrest plate 7 is fixedly connected to the footrest plate mounting surface 321 by means of fasteners; when the footrest plate 7 is retracted to a limit position and the footrest plate mounting surface 321 is oblique with respect to a horizontal plane, a length L of a footrest surface of the footrest plate 7 of a leg assembly 3 is not less than 200 mm. Preferably, on the basis that the footrest plate 7 has no interference with the ground during retraction of the leg assembly 3, the length L of the footrest plate 7 may be 200 mm, 250 mm, 260 mm or 280 mm. An increase of a length of the footrest plate allows a better support strength of the sofa for user's legs and feet, which improves the comfort of the sofa. Specifically, in the present embodiment, the sofa further includes a driving mechanism, which may be a manual driving mechanism or an electric driving mechanism. Under the drive of the driving mechanism, when the leg driven member 14 is a rod-like connecting member, the sofa may achieve two positions, i.e., a sitting position and a lying position. When the leg driven member 14 is an elastic connecting member, the sofa may achieve three positions, i.e., a sitting position, an extending position, and a lying position. In the sitting position, both the leg assembly 3 and the backrest member 4 are retracted to a limit position. In the extending position, the leg assembly 3 is extended forward to a limit position, and the backrest member is kept the same as that in the sitting position. In the lying position, both the leg assembly 3 and the backrest member 4 are extended to a limit position.

In the present disclosure, a height of the seat frame mount is reduced, the leg assembly is simple and compact in structure, and the size of the footrest member is reduced, resulting in a thinner thickness of a front end of the sofa seat, and a more streamlined look of the sofa seat. By combining structures of the seat frame mount, the linkage assembly, and the leg assembly, the dimensions of the sofa support are compressed in a vertical direction after retraction, minimizing the space taken up after retraction, achieving the lowering the seat height and increasing the space at a bottom of the seat frame simultaneously, and may be applied to seat types with a low seat height and high support legs.

Embodiment 2

Figure 7:
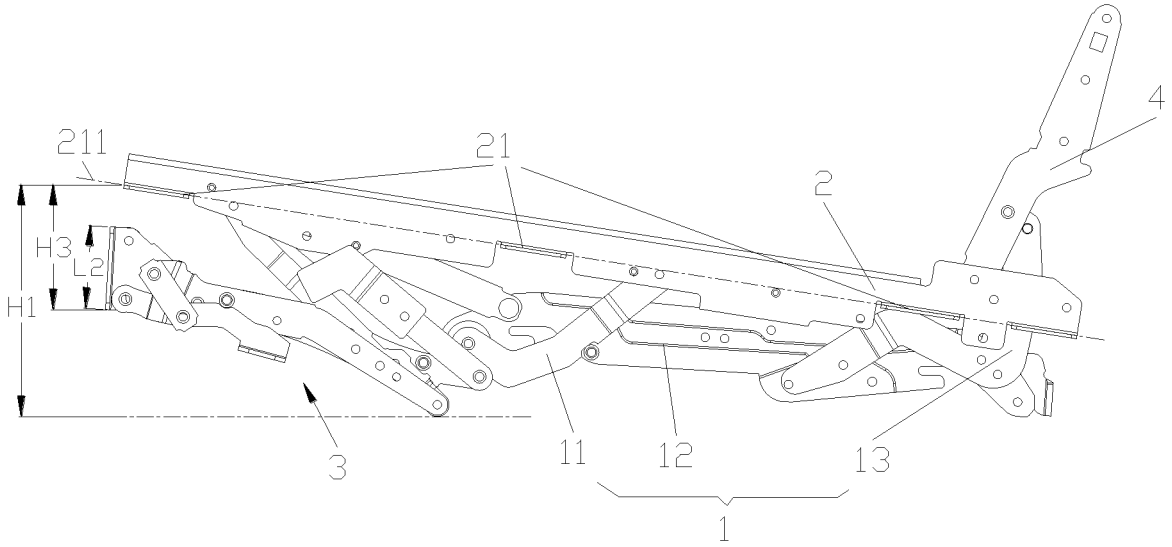
FIG. 7 is a structural diagram of the sofa support in embodiment 2 of the present disclosure.
Figure 8:
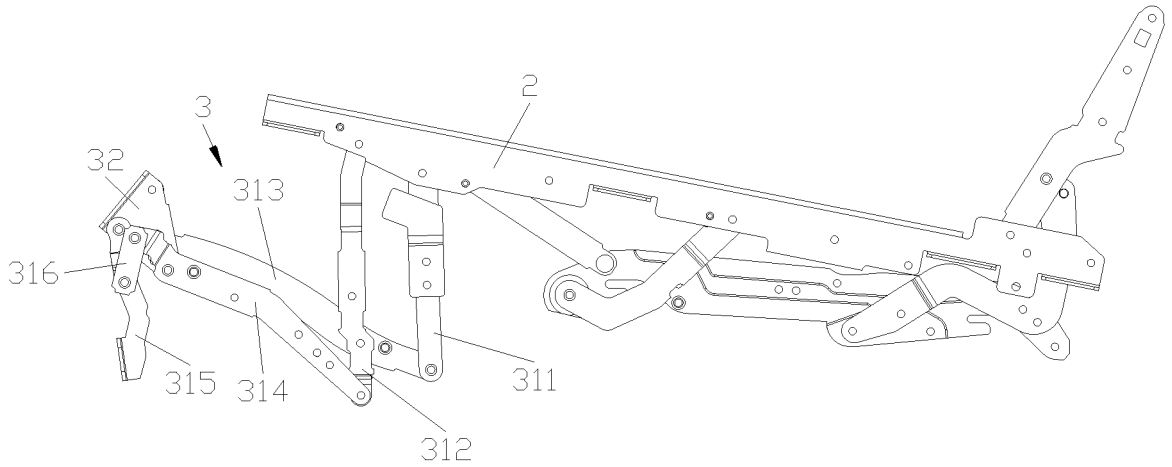
FIG. 8 is a structural diagram of the sofa support and the leg assembly in embodiment 2 of the present disclosure.
Figure 9:
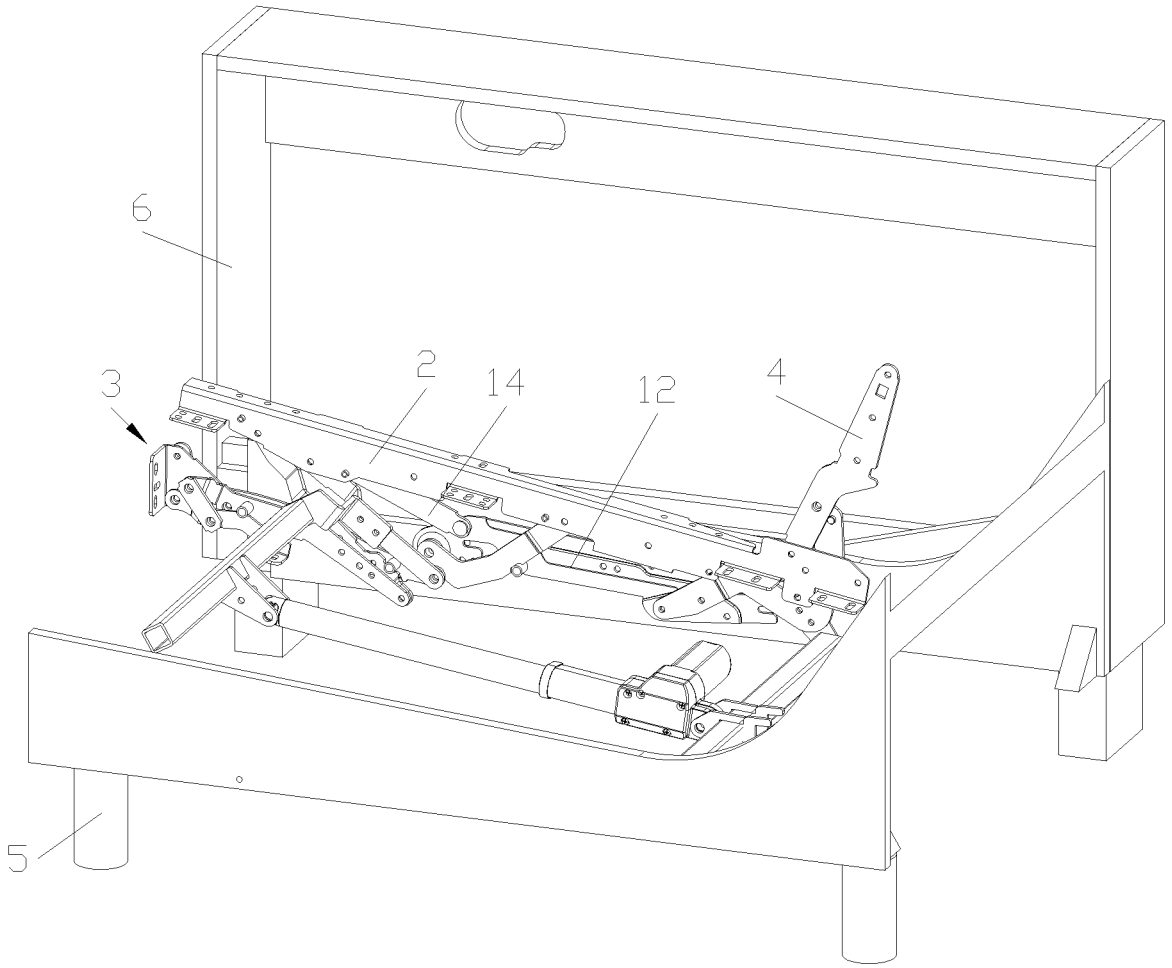
FIG. 9 is a structural diagram of the sofa support and the sofa in embodiment 2 of the present disclosure.

As shown in FIGS. 7-9, in the present embodiment 2, the leg assembly 3 includes a footrest member 32 and an extension footrest 315, the footrest plate mounting surface 321 is perpendicular to a horizontal plane and a distance H3 between a highest point where the seat frame mount 2 is positioned on the seat frame mounting surface 211 and a lowest point of the footrest member 32 in a vertical direction is not greater than 95 mm when the leg assembly 3 is retracted to a limit position. Preferably, the distance H3 may be 90 mm, 92 mm, 94 mm, or 95 mm, and a length L2 of the footrest surface of the footrest member 32 may be 60 mm, 63 mm, or 65 mm. By adopting the sofa support 3 of the present embodiment 2, a height of the seat frame mounting surface 211 is decreased, a distance from the footrest member 32 to the seat frame mounting surface 211 is decreased, and a size of the footrest member 32 is decreased, which results in a lighter and thinner front part of the seat when viewed from a front side of the sofa after being upholstered and having a more pleasing and more distinctive appearance.

Specifically, in the present embodiment, an end of the extension footrest 315 is hinged to the footrest member 32, and a middle of the extension footrest 315 is connected to the second footrest link 314 by means of the footrest connecting member 316. The extension footrest 315 allows for longer extension of the leg assembly and better support for legs and feet, which further improves the comfort of the sofa.

In view of the technical solutions mentioned above, the present disclosure has beneficial effects as follows.

In the present disclosure, a height of the seat frame mount is reduced, the leg assembly is simple and compact in structure, and the size of the footrest member is reduced, resulting in a thinner thickness of a front end of the sofa seat, and a more streamlined look of the sofa seat.

In the present disclosure, by combining structures of the seat frame mount, the linkage assembly, and the leg assembly, the dimensions of the sofa support are compressed in a vertical direction after retraction, minimizing the space taken up after retraction, achieving the lowering of the seat height and increasing the space at a bottom of the seat frame simultaneously, and may be applied to seat types with a low seat height and high legs.

The foregoing description has sufficiently disclosed specific embodiments of the present disclosure. It should be noted that any changes made to specific embodiments of the present disclosure by those skilled in the art do not depart from the scope of the claims of the present disclosure. Accordingly, the scope of the claims of the present disclosure is not limited to the foregoing specific embodiments.

The invention claimed is:

1. A contractible sofa linkage device, comprising a linkage assembly, a seat frame mount hinged to a top of the linkage assembly, and a leg assembly hinged to a front end of the seat frame mount;

an inner side wall of the seat frame mount is provided with a mounting platform, wherein a height of the mounting platform is lower than an upper edge of the seat frame mount, an upper surface of the mounting platform is positioned in an oblique plane and constitutes a seat frame mounting surface, and the mounting platform is a bent part formed by inwardly bending a lower edge of the seat frame mount; and the leg assembly comprises a footrest link assembly and a footrest member, wherein the footrest link assembly is hinged to the seat frame mount, the footrest member comprises a footrest plate mounting surface used to mount a footrest plate, and the footrest plate mounting surface is retracted below the seat frame mount when the footrest link assembly drives the footrest member to be retracted to a limit position.

2. The contractible sofa linkage device according to claim 1, wherein the footrest link assembly comprises a footrest driving link, a footrest driven link, a first footrest link, and a second footrest link, wherein the footrest driving link and the footrest driven link are hinged to a front end of the seat frame mount respectively, an end of the first footrest link is hinged to the footrest driving link, an opposite end of the first footrest link is hinged to an end of the footrest member, an end of the second footrest link is hinged to the footrest driven link, and an opposite end of the second footrest link is hinged to a middle of the footrest member.

3. The contractible sofa linkage device according to claim 2, wherein a vertical distance from a connecting point between the first footrest link and the footrest member to the footrest plate mounting surface is greater than a vertical distance from a connecting point between the second footrest link and the footrest member to the footrest plate mounting surface.

4. The contractible sofa linkage device according to claim 3, wherein an included angle a between the footrest plate mounting surface and a horizontal plane is 20°-26° when the leg assembly is retracted to a limit position.

5. The contractible sofa linkage device according to claim 4, wherein a distance H2 between a highest point where the seat frame mount is positioned on the seat frame mounting surface and a highest point of the footrest plate mounting surface in a vertical direction is not greater than 50 mm when the leg assembly is retracted to a limit position.

6. The contractible sofa linkage device according to claim 1, wherein the footrest plate mounting surface is perpendicular to a horizontal plane and a vertical distance H3 between a highest point where the seat frame mount is positioned on the seat frame mounting surface and a lowest point of the footrest member is not greater than 95 mm when the leg assembly is retracted to a limit position.

7. The contractible sofa linkage device according to claim 1, wherein the linkage assembly comprises a linkage restricting member, a mounting lateral plate, a backrest connecting member, and a leg driven member;

an end of the linkage restricting member is hinged to a middle of the seat frame mount, an opposite end of the linkage restricting member is hinged to an end of the mounting lateral plate, an opposite end of the mounting lateral plate is connected to the backrest connecting member, an end of the leg driven member is hinged to the mounting lateral plate, and an opposite end of the leg driven member is connected to the leg assembly.

8. The contractible sofa linkage device according to claim 7, wherein the linkage restricting member comprises a first connecting end connected to the mounting lateral plate and a second connecting end connected to an outer side wall of the seat frame mount, and an opening direction of an included angle formed by connecting the first connecting end and the second connecting end is facing the seat frame mount.

9. The contractible sofa linkage device according to claim 8, wherein a connecting point between the leg driven member and the mounting lateral plate is positioned in an opening direction of an included angle formed by connecting the first connecting end and the second connecting end.

10. The contractible sofa linkage device according to claim 7, wherein the mounting lateral plate and the backrest connecting member are fixedly connected or integrally formed.

11. A sofa support, comprising a linkage assembly, a seat frame mount, a leg assembly, and a backrest member, wherein the seat frame mount is hinged to a top of the linkage assembly, the leg assembly is hinged to a front end of the seat frame mount, and the backrest member is hinged to an end of the seat frame mount distal to the leg assembly;

an inner side wall of the seat frame mount is provided with a mounting platform, wherein a height of the mounting platform is lower than an upper edge of the seat frame mount, an upper surface of the mounting platform is positioned in an oblique plane and constitutes a seat frame mounting surface, and the mounting platform is a bent part formed by inwardly bending a lower edge of the seat frame mount;

the leg assembly comprises a footrest link assembly and a footrest member, wherein the footrest link assembly is hinged to the seat frame mount, the footrest member comprises a footrest plate mounting surface used to mount a footrest plate, and the footrest plate mounting surface is retracted below the seat frame mount when the footrest link assembly drives the footrest member to be retracted to a limit position; and a vertical distance H1 between a highest point where the seat frame mount is positioned on the seat frame mounting surface and a lowest point of the leg assembly is not greater than 170 mm when the sofa support is retracted to a limit position.

12. The sofa support according to claim 11, wherein the linkage assembly comprises a linkage restricting member, a mounting lateral plate, a backrest connecting member, and a leg driven member;

an end of the linkage restricting member is hinged to a middle of the seat frame mount, an opposite end of the linkage restricting member is hinged to an end of the mounting lateral plate, an opposite end of the mounting lateral plate is connected to the backrest connecting member, an end of the leg driven member is hinged to the mounting lateral plate, an opposite end of the leg driven member is connected to the leg assembly, and the backrest connecting member is hinged to a middle of the backrest member.

13. The sofa support according to claim 12, wherein a difference in height H between the footrest plate mounting surface and a highest point of the backrest member is not less than 80 mm when the leg assembly is extended to a limit position.

14. The sofa support according to claim 11, wherein the mounting platform is a bent part formed by inwardly bending a lower edge of the seat frame mount.

15. A sofa, comprising a seat support leg, an armrest frame and a sofa support;

there are two sets of sofa supports disposed oppositely, the sofa support is connected to the armrest frame, the seat support leg is provided below the armrest frame, and a height of the seat support leg is 120-150 mm;

the sofa support comprises a linkage assembly, a seat frame mount, a leg assembly, and a backrest member, wherein the seat frame mount is hinged to a top of the linkage assembly, the leg assembly is hinged to a front end of the seat frame mount, and the backrest member is hinged to an end of the seat frame mount distal to the leg assembly;

an inner side wall of the seat frame mount is provided with a mounting platform, wherein a height of the mounting platform is lower than an upper edge of the seat frame mount, an upper surface of the mounting platform is positioned in an oblique plane and constitutes a seat frame mounting surface, and the mounting platform is a bent part formed by inwardly bending a lower edge of the seat frame mount;

the leg assembly comprises a footrest link assembly and a footrest member, wherein the footrest link assembly is hinged to the seat frame mount, the footrest member comprises a footrest plate mounting surface used to mount a footrest plate, and the footrest plate mounting surface is retracted below the seat frame mount when the footrest link assembly drives the footrest member to be retracted to a limit position; and a vertical distance H1 between a highest point where the seat frame mount is positioned on the seat frame mounting surface and a lowest point of the leg assembly is not greater than 170 mm when the sofa support is retracted to a limit position.

16. The sofa according to claim 15, wherein the linkage assembly comprises a linkage restricting member, a mounting lateral plate, a backrest connecting member, and a leg driven member;

an end of the linkage restricting member is hinged to a middle of the seat frame mount, an opposite end of the linkage restricting member is hinged to an end of the mounting lateral plate, an opposite end of the mounting lateral plate is connected to the backrest connecting member, an end of the leg driven member is hinged to the mounting lateral plate, an opposite end of the leg driven member is connected to the leg assembly, and the backrest connecting member is hinged to a middle of the backrest member.

17. The sofa according to claim 16, wherein a difference in height H between the footrest plate mounting surface and a highest point of the backrest member is not less than 80 mm when the leg assembly is extended to a limit position.

18. The sofa according to claim 16, further comprising a footrest plate, and the footrest plate is fixedly connected to the footrest plate mounting surface; when the footrest plate is retracted to a limit position and the footrest plate mounting surface is oblique with respect to a horizontal plane, a length L of a footrest surface of the footrest plate of a leg assembly is not less than 200 mm.

19. The sofa according to claim 15, wherein the mounting platform is a bent part formed by inwardly bending a lower edge of the seat frame mount.

20. The sofa according to claim 15, further comprising a footrest plate, and the footrest plate is fixedly connected to the footrest plate mounting surface; when the footrest plate is retracted to a limit position and the footrest plate mounting surface is oblique with respect to a horizontal plane, a length L of a footrest surface of the footrest plate of a leg assembly is not less than 200 mm.

* * * * *